US009133003B1

(12) United States Patent
Glaser et al.

(10) Patent No.: US 9,133,003 B1
(45) Date of Patent: Sep. 15, 2015

(54) CLOSURE ASSEMBLY INCLUDING REMOVABLE WRENCH AND METHOD FOR SEALING A CONTAINER

(71) Applicant: Fisher Scientific Company, L.L.C., Fair Lawn, NJ (US)

(72) Inventors: John T. Glaser, Hawthorne, NJ (US); Jonathan David Assaraf, New York, NY (US)

(73) Assignee: Fisher Scientific Company, L.L.C., Fair Lawn, NJ (US)

( * ) Notice: Subject to any disclaimer, the term of this patent is extended or adjusted under 35 U.S.C. 154(b) by 54 days.

(21) Appl. No.: 14/199,669

(22) Filed: Mar. 6, 2014

(51) Int. Cl.

| | |
|---|---|
| ***B67B 7/18*** | (2006.01) |
| ***B65B 7/28*** | (2006.01) |
| ***B65D 1/02*** | (2006.01) |

(52) U.S. Cl.
CPC ..... *B67B 7/18* (2013.01); *B65B 7/2835* (2013.01); *B65D 1/0253* (2013.01); *B65D 2543/00888* (2013.01)

(58) Field of Classification Search
CPC .. B65D 1/0253; B65D 1/023; B65D 41/0485; B65D 41/04; B65D 51/243; B65D 51/24; B67B 7/18; B67B 7/15; B67B 7/14; B65B 7/2835
USPC ..... 220/284, 260, 293, 288; 215/46, 44, 215/302, 303, 304, 295, 329, 316; 53/492, 53/490, 485, 476, 471; 81/3.57, 3.55, 81/3.45, 3.41, 3.4
See application file for complete search history.

(56) References Cited

U.S. PATENT DOCUMENTS

| | | | | |
|---|---|---|---|---|
| 1,636,531 | A * | 7/1927 | Obiol | 215/302 |
| 2,493,438 | A | 1/1950 | Boucher | |
| 2,542,329 | A | 2/1951 | Hammond, Jr. | |
| 4,209,100 | A | 6/1980 | Uhlig | |
| D435,765 | S | 1/2001 | Owens et al. | |
| D516,425 | S | 3/2006 | Haffner et al. | |

FOREIGN PATENT DOCUMENTS

| | | | |
|---|---|---|---|
| FR | 2825349 | A1 | 12/2002 |

* cited by examiner

*Primary Examiner* — Robert J Hicks
(74) *Attorney, Agent, or Firm* — Wood, Herron & Evans, LLP

(57) ABSTRACT

A closure assembly includes a cap including a radially outer lip, a radially inner projection, and a groove located therebetween, and a threaded portion configured for threaded engagement with a container. The assembly also includes a wrench including a handle and a gripping portion. At least part of the gripping portion is configured to extend into the groove in an assembled position with the gripping portion engaging the outer lip and the inner projection such that rotation of the wrench in opposite directions results in the cap being loosened or tightened relative to the container. The wrench may also be used to hold the cap when the cap is removed from the container.

21 Claims, 6 Drawing Sheets

CLOSURE ASSEMBLY INCLUDING REMOVABLE WRENCH AND METHOD FOR SEALING A CONTAINER

FIELD OF THE INVENTION

The present invention generally relates to caps for use with containers, and, more particularly, to a closure assembly for use with a container to open and close an opening in the container.

BACKGROUND

It is common to close or seal an opening of a container with a threaded cap. In certain situations it is advantageous, and often even mandated, to require a certain amount of torque to remove the cap from the container. For example, where the container includes certain hazardous materials, caps and containers may be designed with minimum opening torque requirements, in order to prevent unwanted disengagement of the cap from the container which might allow escape of the materials from the container during shipment or handling, or to prevent unwanted access to the contents of the container by children, for example. While minimum opening torque requirements are generally effective at preventing such unwanted occurrences due to a tight fit between the cap and the container, there are undesired consequences when applying such requirements. For example, certain users may lack the strength to provide the requisite torque to remove the cap from the container. As the effective diameter of the cap increases, providing the requisite torque may become even more difficult for certain members of the general population, and especially for those who generally lack strength or have relatively small hands.

Consequently, there remains a need in the art for a closure assembly that overcomes the disadvantages identified above.

SUMMARY

The present invention overcomes the shortcomings and drawbacks of closure assemblies heretofore known. While the invention will be described in connection with certain embodiments, it will be understood that the invention is not limited to these embodiments. On the contrary, the invention includes all alternatives, modifications and equivalents as may be included within the spirit and scope of the present invention.

To that end, rather than relegating a user to rely on his or her general strength or hand size, in one embodiment, a closure assembly is provided for use with a variety of shapes and sizes of containers meant for containing a variety of materials including, but not limited to, laboratory chemicals. The closure assembly includes a cap having a radially outer lip, a radially inner projection, and a groove located therebetween. The cap also includes a threaded portion configured for threaded engagement with a container. The assembly also includes a wrench having a handle and a gripping portion. At least part of the gripping portion is configured to extend into the groove in an assembled position with the gripping portion engaging the outer lip and the inner projection such that rotation of the wrench in opposite directions results in the cap being loosened or tightened relative to the container.

In one embodiment, the handle includes a flange extending transversely therefrom that is configured to contact an outer portion of the outer lip in the assembled position.

In another embodiment, the wrench includes a magnet which may be used for coupling the wrench to a magnetic object to store the wrench when not in use.

In another embodiment, a closure assembly and a container are provided. The container includes a container body. The closure assembly includes a cap including a radially outer lip, a radially inner projection, and a groove located therebetween. The cap also includes a threaded portion configured for threaded engagement with a container. The closure assembly also includes a wrench including a handle and a gripping portion, wherein at least part of the gripping portion is configured to extend into the groove in an assembled position with the gripping portion engaging the outer lip and the inner projection such that rotation of the wrench in opposite directions results in the cap being loosened or tightened relative to the container.

A method for sealing an opening provided in a container with a closure assembly is also provided. The closure assembly includes a cap having a radially outer lip, a radially inner projection, and a groove located therebetween. The cap also includes a threaded portion configured for threaded engagement with a container. The method includes directing a wrench having a handle and a gripping portion into engagement with the cap such that at least part of the gripping portion extends into the groove and the gripping portion engages outer lip and the inner projection. The method also includes rotating the wrench to thereby loosen or tighten the cap relative to the container.

In one embodiment, the method further includes lifting and removing the cap from the container using the wrench once the cap is sufficiently loosened relative to the container.

In another embodiment, the method further includes disengaging the wrench and the cap, and storing the wrench. Storing the wrench may include magnetically coupling the wrench to an object.

Various additional aspects and features of the invention will become more readily apparent to those of ordinary skill in the art upon review of the following detailed description of the illustrative embodiments.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, serves to explain the principles of the invention.

Figure 1:
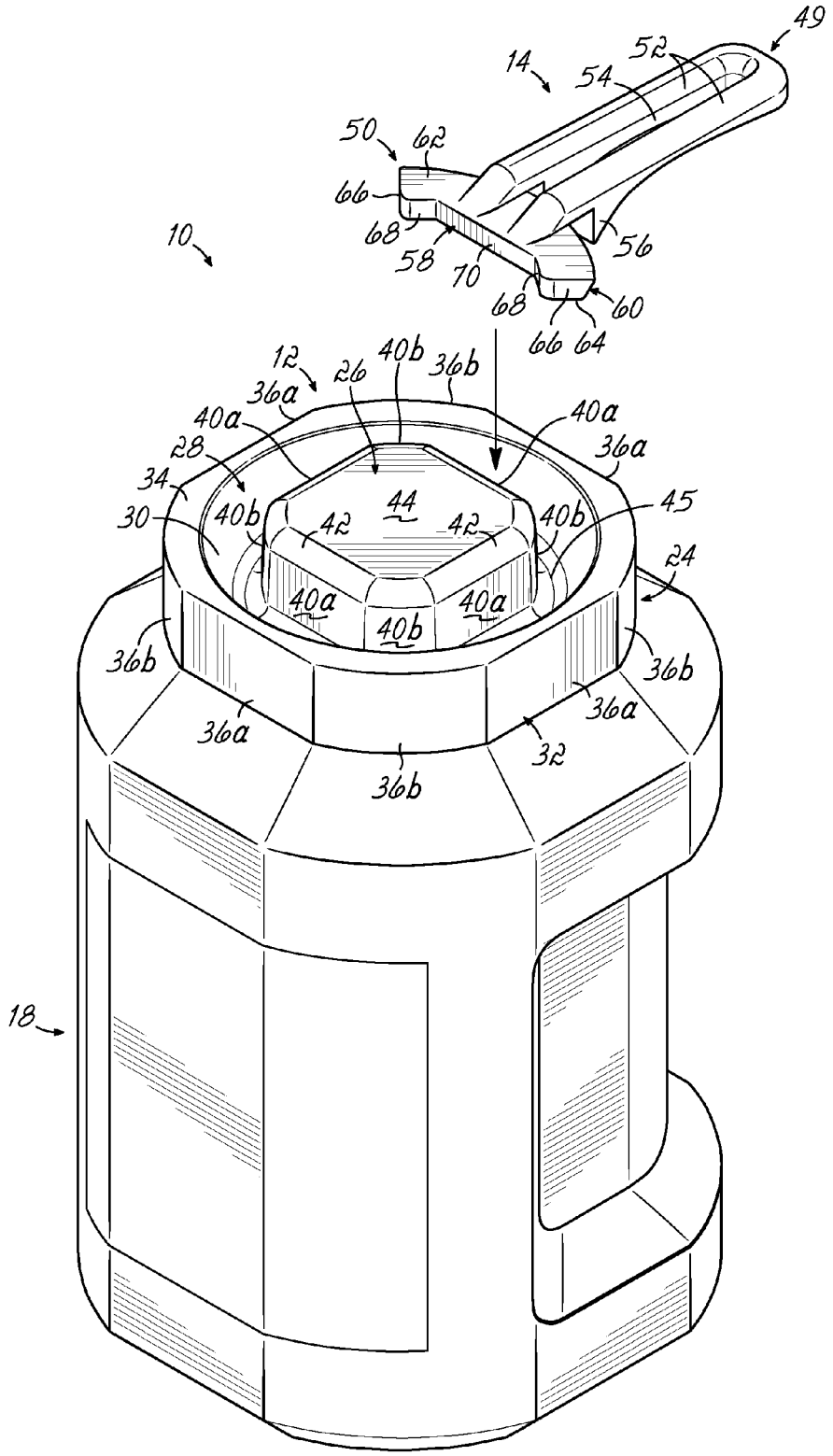
FIG. 1 is a perspective view of a closure assembly according to one embodiment of the present invention, with a cap of the closure assembly being assembled on a container, and a wrench of the closure assembly being disassembled from the cap.

It should be understood that the appended drawings are not necessarily to scale, presenting a somewhat simplified representation of various preferred features illustrative of the basic principles of the invention. The specific design features of the sequence of operations as disclosed herein, including, for example, specific dimensions, orientations, locations, and shapes of various illustrated components, will be determined in part by the particular intended application and use environment. Certain features of the illustrated embodiments may have been enlarged or distorted relative to others to facilitate visualization and clear understanding.

DETAILED DESCRIPTION

Referring to FIGS. 1-5, a closure assembly 10 according to one embodiment of the present invention is shown and includes a cap 12 and a wrench 14. As shown, the cap 12 may be used to close or essentially seal an opening 16 of a container 18. In that regard, the cap 12 and the container 18 are configured to threadably engage one another and each includes complementary threads 20, 22, respectively. In order to engage or disengage the cap 12 relative to the container 18, the wrench 14 and cap 12 may be coupled or engaged into an assembled position, as will be described in more detail below, and the wrench 14 may then essentially be used as a moment arm to rotate the cap 12 relative to the container 18 to thereby loosen or tighten the cap 12 relative to the container 18.

Figure 5:
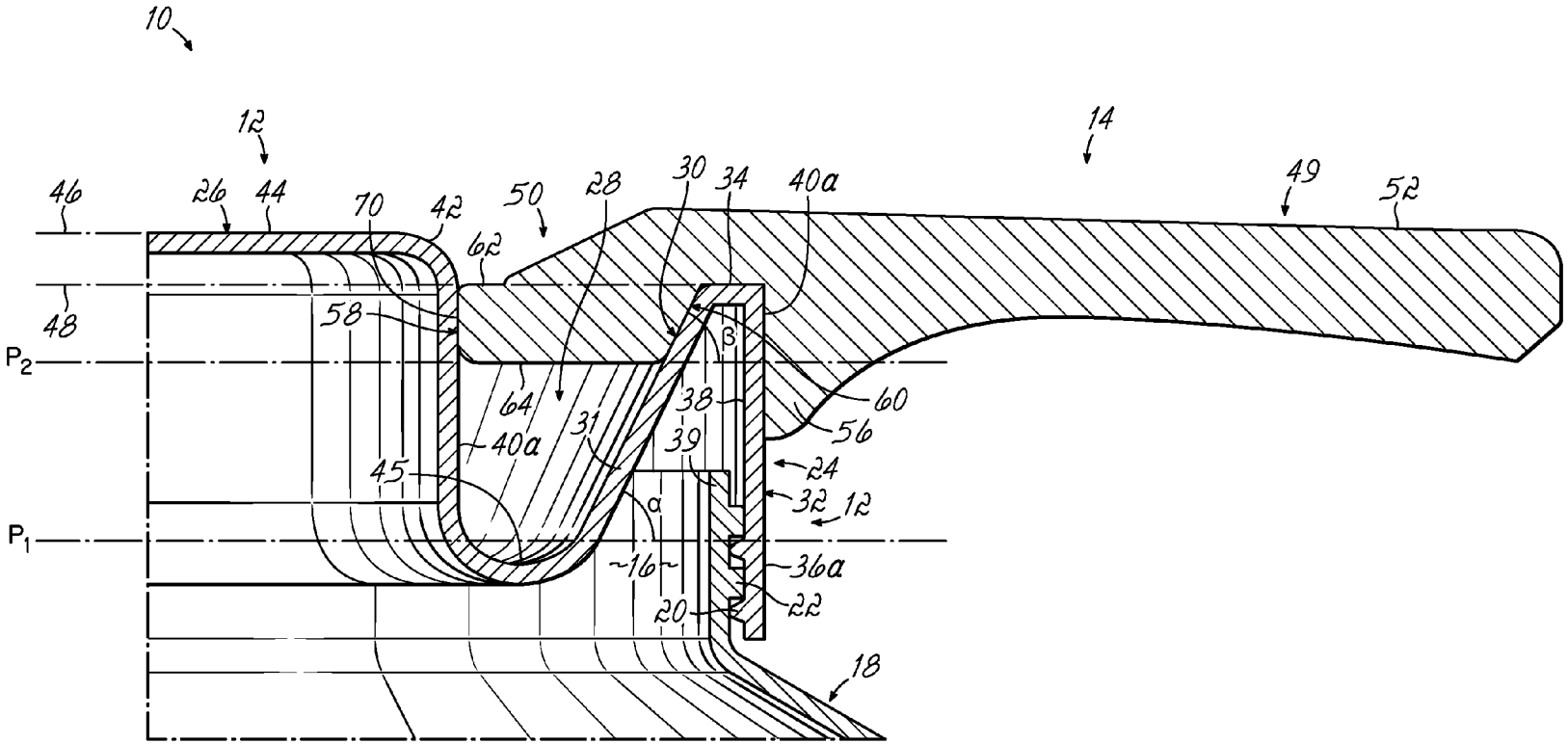
FIG. 5 is a partial cross-sectional view of the closure assembly taken along line 5-5 of FIG. 4.

In one embodiment, the cap 12 includes a radially outer lip 24, a radially inner projection or boss 26, and a groove 28 located therebetween. The outer lip 24 may include a radially inner portion 30, a radially outer portion 32, and an upper, generally planar portion 34 extending between the inner and outer portions 30, 32. In this embodiment, the inner portion 30 defines a radially outward boundary of the groove 28. As best seen in FIG. 5, the inner portion 30 may include a generally planar portion 31 that is sloped away from the inner projection 26 so that the planar portion 31 is disposed at an angle $\alpha$ relative to a horizontal plane $P_1$ extending through the cap 12 as shown in FIG. 5. The outer portion 32 may define a radially outward surface of the cap 12, and may be generally polygonal in shape. More specifically, the outer portion 32 may be generally octagonal and include eight faces, four of which are planar faces 36*a* and four of which are curved faces 36*b*. Each of the curved faces 36*b* is positioned between an adjacent set of planar faces 36*a*.

In one embodiment, the outer portion 32 also includes an inner surface 38 which, in order to threadably couple or engage the container 18, includes male threads 20 that extend radially inwardly for engaging corresponding female threads 22 formed on a neck 39 of the container 18. It will be appreciated that the shape and configuration of the outer lip 24 is not so limited to the configuration shown. For example, in an alternative embodiment, the outer lip 24 may include a different shape, which may or may not depend on the shape or configuration of the wrench 14. Furthermore, the number and ordering of planar faces 36*a* and curved faces 36*b* may be reconfigured in other embodiments. Moreover, the outer lip 24, rather than being a continuous structure (i.e., in terms of circumference), may be at least one or a set of discrete flanges or lips (not shown) with spaces or gaps between adjacent flanges or lips.

In the embodiment shown, the inner projection 26 is shaped such that it is generally polygonal in shape. More specifically, as shown, the inner projection 26 is generally octagonal and includes a set of eight faces, four of which are generally planar faces 40*a* and four are generally curved faces 40*b*, with each of the curved faces 40*b* being positioned between an adjacent set of planar faces 40*a*. The inner projection 26 also includes eight rounded edges 42, and a generally planar top portion 44. Each face 40*a*, 40*b* is generally oriented to face the inner portion 30 of the outer lip 24. Of course, it will be appreciated that the shape of the inner projection 26 is not so limited and may be shaped differently. For example, rather than being a continuous structure, in an alternative embodiment, the inner projection 26 may be at least one or a set of discrete projections or bosses. Such an alternative configuration or shape may depend on the characteristics of the cap 12, as well as characteristics of the wrench 14, as described in more detail below.

As shown in FIG. 5, for example, the inner projection 26 defines a radially inward boundary of the groove 28 and the outer lip 24 defines a radially outward boundary of the groove 28. The groove 28 may also be defined in part by a curved portion 45 connecting the radially inner portion 30 of outer lip 24 to the inner projection 26. As best seen in FIG. 5, the top portion 44 of the inner projection 26 lies along a first plane 46 that is situated above a second plane 48 along which the upper portion 34 of the outer lip 24 lies. The upper boundary of the groove 28, therefore, may be defined by the first plane 46, the second plane 48, some point in between the first and second planes 46, 48, above the first plane 46, or below the first and second planes 46, 48. The cap 12 defines a total closure for opening 16 when engaged with container 18. Notably, as best shown in FIG. 5, when in the assembled position, the curved portion 45 of the cap 12 may extend into the opening 16 of container 18.

In one embodiment, the wrench 14 includes a handle 49 and a gripping portion 50. The wrench 14 is configured to be located or placed into an assembled position or configuration with the cap 12 such that at least part of the gripping portion 50 extends into, and is closely received within, the groove 28. The handle 49 may be a generally elongate structure and includes two generally parallel portions 52, with an elongate space or opening 54 located therebetween. In the embodiment shown, the handle 49 also includes a flange 56 projecting transversely therefrom (perpendicularly as shown), which engages or contacts the outer portion 32 of the outer lip 24 in the assembled position, as described in more detail below.

Figure 2:
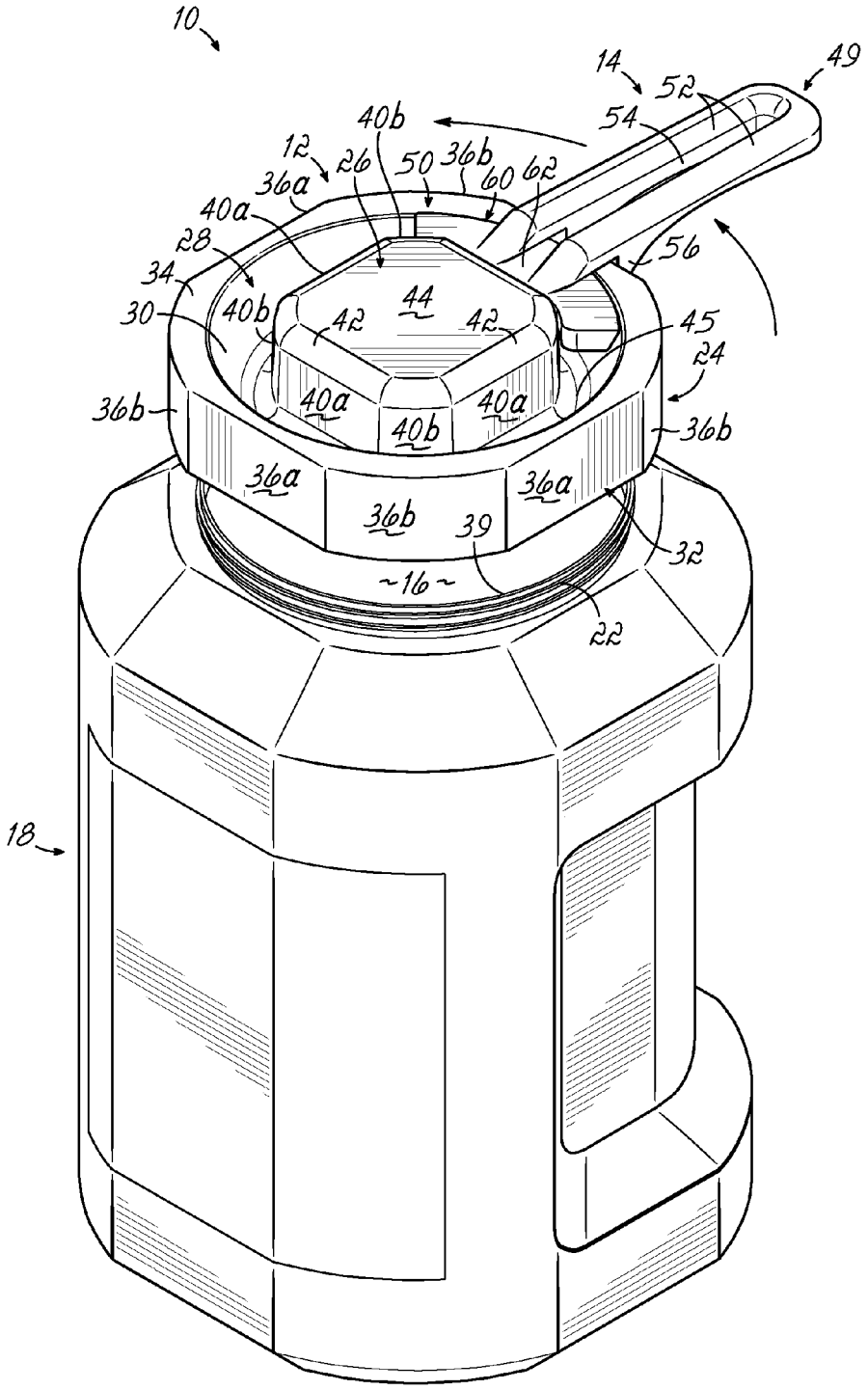
FIG. 2 is a view similar to FIG. 1, showing the cap disassembled from the container.
Figure 3:
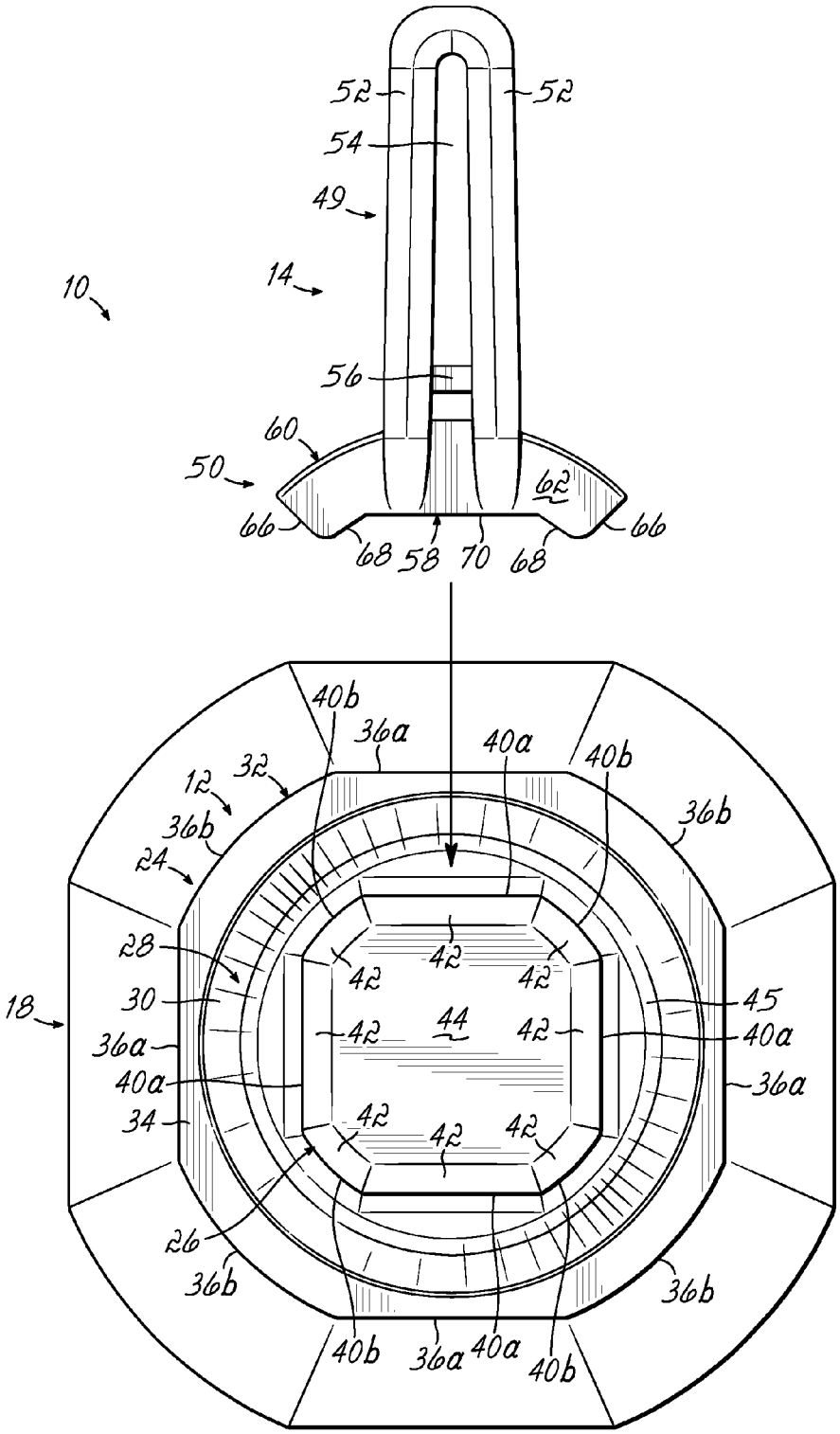
FIG. 3 is a top plan view of the closure assembly of FIG. 1, showing the wrench of the closure assembly disassembled from the cap.
Figure 4:
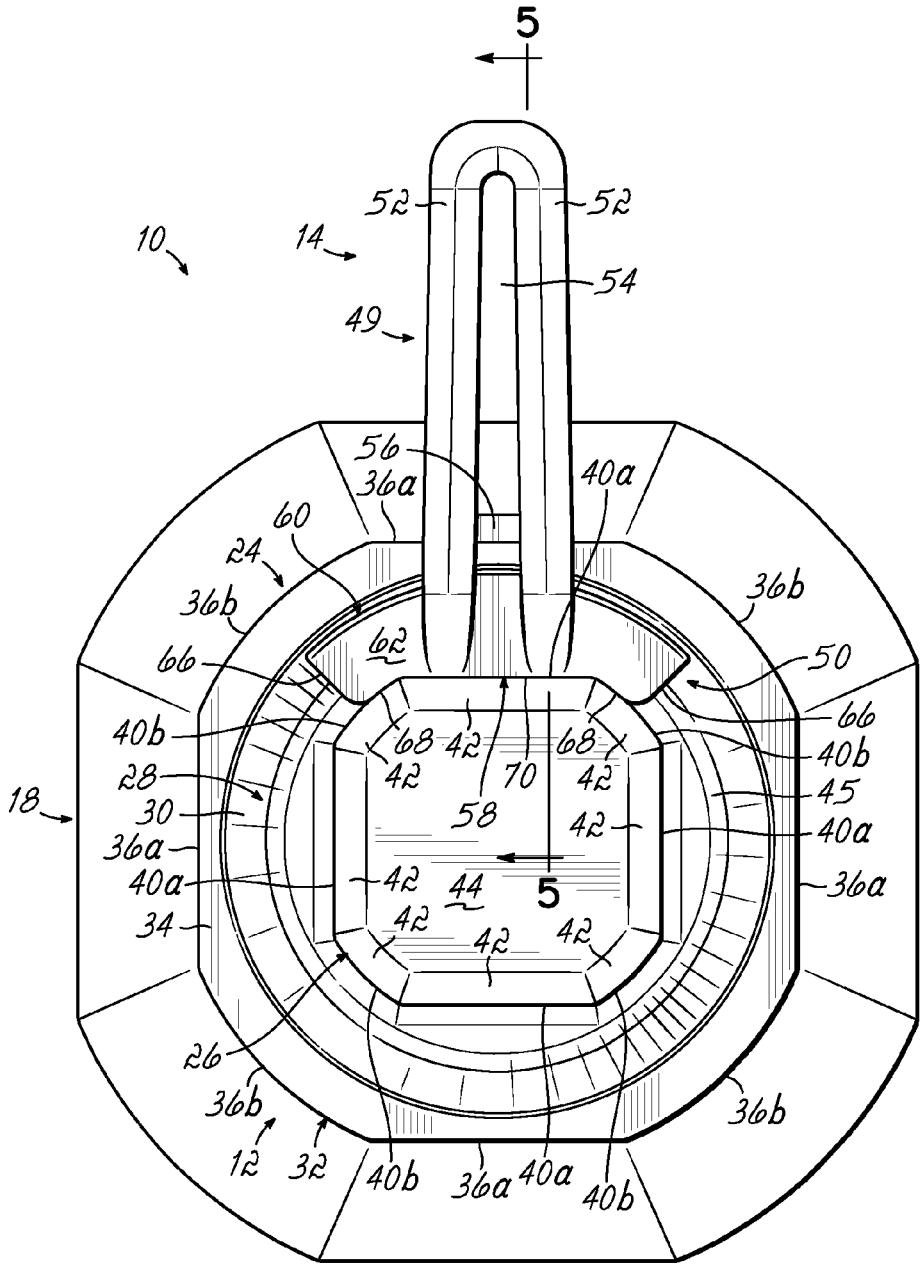
FIG. 4 is a view similar to FIG. 3, showing the wrench of the closure assembly assembled with the cap.

The gripping portion 50 is defined by a front portion 58 and a rear portion 60, each of which is shaped to be closely received within the groove 28. The gripping portion 50 is further defined by a top face 62, a bottom face 64, and opposing end faces 66. In one embodiment, the handle 49 and gripping portion 50 are joined together at the top face 62. The front portion 58 is essentially a gripping surface having opposing jaws 68 with a middle gripping portion 70 therebetween and is configured to engage the inner projection 26 in the assembled position. The rear portion 60 is configured to engage the inner portion 30 of the outer lip 24 in the assembled position, as shown in FIGS. 2 and 4. The rear portion 60 is generally arc-shaped (as viewed from the top, such as shown in FIGS. 3 and 4) such that the shape of the rear portion 60 is shaped similarly to the inner portion 30 of the outer lip 24. Further in that regard, as best seen in FIG. 5, the rear portion 60 extends between the top and bottom faces 62, 64 and tapers at an angle $\beta$ relative to a horizontal plane $P_2$ extending through the cap 12 as shown in FIG. 5 such that the slope or angle of the rear portion 60 generally matches, or is similar to, the slope and/or curvature of the planar inner portion 31 of the outer lip 24. It will be appreciated that changes to the shape of the groove 28 in the cap 12 may be matched by the corresponding shape of the wrench 14 without departing from the scope of the invention.

In order to assemble the cap 12 and wrench 14 into the assembled position as shown in FIGS. 2 and 4, the wrench 14 is directed into engagement with the cap 12 as shown in FIG. 1 such that the gripping portion 50 extends into the groove 28 and is closely received therein. In one embodiment, the gripping portion 50 is sized and configured such that it is frictionally held within the groove 28. In that regard, the front portion 58 engages with the inner projection 26 and the rear portion 60 engages with the planar inner portion 31 of the outer lip 24 so that the gripping portion 50 is frictionally held within the groove 28. More specifically, the middle gripping portion 70 contacts a planar face 40*a* of the inner projection 26, while the jaws 68 contact the curved faces 40*b* on each side of the planar face 40*a*. Because the geometries of the front portion 58 (particularly of the jaws 68 and the middle gripping portion 70) are similar to the geometries of the inner projection 26, a close fit is provided between the front portion 58 and the inner projection 26.

In this regard, the non-circular profiles of the front portion 58 and the inner projection 26 prevents the wrench 14 from rotating around the inner projection 26. Accordingly, torque applied to the wrench 14 is transmitted to the cap for coupling or uncoupling the cap 12 relative to the container 18. Moreover, because the geometries of the rear portion 60 and the inner portion 30 are similar, a close fit is also provided at the rear portion 60. The frictional engagement between the cap 12 and wrench 14 is further aided by the engagement of the handle 49 with other portions of the outer lip 24. More specifically, a part of the handle 49 extends over the upper portion 34 of the outer lip 24 and the flange 56 engages the outer portion 32 of the outer lip 24. As best seen in FIG. 5, the rear portion 60, portions of the handle 49, and the flange 56 essentially envelop the outer lip 24, thereby adding to the closely held, frictional engagement of the cap 12 and wrench 14 in the assembled position.

Of course, the assembled position shown is one of several possibilities and it is anticipated that other configurations of the assembled position are possible, which essentially depend on the position of the wrench 14 relative to the cap 12. It is also anticipated that other geometries of the gripping portion 50, inner projection 26, and outer lip 24 are possible to provide the close fit between the wrench and the cap 12. Moreover, in any of the embodiments as described herein, or in other embodiments, either the radially inward boundary or the radially outward boundary of the groove 28 may be defined by a multi-faceted surface. The gripping portion 50 may have jaws (i.e., jaws 68) that are complementary in shape to the multi-faceted surface such that the engagement of the gripping portion 60 with the groove 28 prevents the wrench 14 from rotating relative to the cap 12.

Once the cap 12 and wrench 14 are in the assembled position as shown in FIGS. 2 and 4, the wrench 14 may be rotated to thereby rotate the cap 12 in order to tighten or loosen the threaded engagement between the cap 12 and the container 18. In order to tighten the threaded engagement, the wrench 14 is rotated in a first direction. In order to loosen the threaded engagement, the wrench 14 is rotated in a second direction that is opposite to the first direction. When the wrench 14 is rotated to loosen the cap 12 from the container 18 to a point where the cap 12 is sufficiently loosened from the container 18, the cap 12 may then be removed from the container 18. In order to accomplish removal of the cap 12, a user may simply lift the wrench 14 and rely on the close, frictional engagement between the cap 12 and the wrench 14 in order to lift the cap 12 from the container 18 to provide access to the container 18 via opening 16. Once the user no longer desires access to the opening 16 of the container 18, the user may grasp the wrench 14, which is still closely engaging the cap 12, and use the wrench 14 to place the cap 12 onto the container 18. Then, the user may once again rotate the wrench 14 in the appropriate direction to tighten the threaded engagement between the cap 12 and the container 18. The user may then disengage the wrench 14 and the cap 12, and store the wrench 14 for later use.

Figure 6:
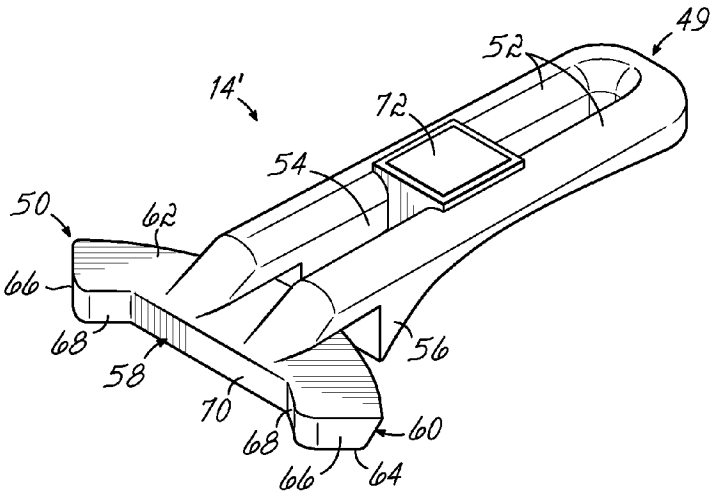
FIG. 6 is perspective view of a wrench of the closure assembly according an alternative embodiment of the present invention.

Referring to FIG. 6, in an alternative embodiment, the wrench 14' includes a magnetic feature, such as a magnet 72, which enables the wrench 14' to be magnetically coupled with a magnetically conductive object or surface for storage. As shown, the magnet 72 is positioned on the handle 49, but may be on different portions of the wrench 14'. Alternatively, rather than including a separate magnet 72, the entire wrench 14' or portions of the wrench 14' may be magnetized. Many of the components of this embodiment of the wrench 14' are identical or substantially similar to the components described above with reference to the embodiment shown in FIGS. 1-5, and these components have been marked with the same reference numbers in this embodiment without additional explanation.

Figure 7:
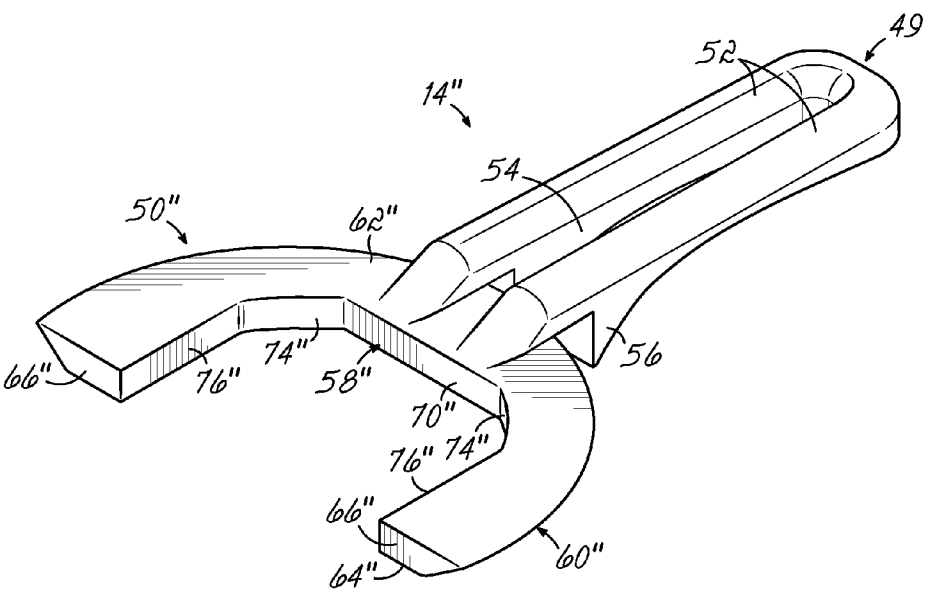
FIG. 7 is a view similar to FIG. 6, showing a wrench of the closure assembly according to a second alternative embodiment of the present invention.

Referring to FIG. 7, an alternative embodiment of a wrench 14" is shown. Many of the components of this embodiment of the wrench 14" are identical or substantially similar to the components described above with reference to the embodiment shown in FIGS. 1-5, and these components have been marked with the same reference numbers in this embodiment without additional explanation. In this embodiment, the gripping portion 50" is defined by a front portion 58" and a rear portion 60", each of which is shaped to be closely received within the groove 28. The gripping portion 50" is further defined by a top face 62", a bottom face 64", and opposing end faces 66". As shown, the gripping portion 50" and the handle 49 meet at the top face 62". The front portion 58" is essentially a gripping surface having opposing jaws 68" with a middle gripping portion 70 therebetween and is configured to engage the inner projection 26 in the assembled position, similar to the embodiment shown in FIGS. 2 and 4. As shown, the gripping portion 60" includes elongate jaws 68", which include a first portion 74" extending from each side of middle gripping portion 70". Elongate jaws 68" may also include a second portion 76" extending from each of the first portions 74". Elongate jaws 68" terminate at end faces 66". In the embodiment shown, each of the second portions 76" is generally parallel to one another and generally perpendicular to the middle gripping portion 70". The wrench 14", like other embodiments, is configured to be located or placed into an assembled position or configuration with cap 12. In the assembled position, the second portions 76" would engage opposing (and also generally parallel) planar faces 40*a* of the inner projection 26.

Similarly, the rear portion 60" is configured to engage the planar inner portion 31 of the outer lip 24 in the assembled position. The rear portion 60" is generally arc-shaped (as in other embodiments) such that the shape of the rear portion 60" is shaped similarly to the planar inner portion 31 of the outer lip 24. It will be appreciated that any changes to the shape of the groove 28 in the cap 12 may be matched by the corresponding shape of the wrench 14" without departing from the scope of the invention.

While the present invention has been illustrated by description of various embodiments and while those embodiments have been described in considerable detail, it is not the intention of applicant to restrict or in any way limit the scope of the appended claims to such details. Additional advantages and modifications will readily appear to those skilled in the art. The invention in its broader aspects is therefore not limited to the specific details and illustrative examples shown and described. Accordingly, departures may be made from such details without departing from the spirit or scope of applicant's invention.

What is claimed is:

1. A closure assembly for use in sealing an opening provided in a container, comprising:

a cap including a radially outer lip, a radially inner projection, and a groove located therebetween, and a threaded portion configured for threaded engagement with a container; and a wrench including a handle and a gripping portion, wherein at least part of the gripping portion is configured to extend into the groove in an assembled position with the gripping portion engaging the outer lip and the inner projection such that rotation of the wrench in opposite directions results in the cap being loosened or tightened relative to the container.

2. The closure assembly of claim 1, wherein the handle extends radially outward from the gripping portion.

3. The closure assembly of claim 1, wherein the outer lip defines a radially outward boundary of the groove and the inner projection defines a radially inward boundary of the groove.

4. The closure assembly of claim 3, wherein the handle includes a flange extending transversely therefrom that is configured to contact an outer portion of the outer lip in the assembled position.

5. The closure assembly of claim 3, wherein the gripping portion is configured to be frictionally held within the groove.

6. The closure assembly of claim 1, wherein a portion of the gripping portion is complementary in shape to a portion of the inner projection.

7. The closure assembly of claim 1, wherein a portion of the gripping portion is defined by opposing jaws.

8. The closure assembly of claim 7, wherein a portion of each of the jaws extends generally parallel to one another.

9. The closure assembly of claim 1, wherein the wrench includes a magnet.

10. The closure assembly of claim 1, wherein:

either a radially inward boundary or a radially outward boundary of the groove is defined by a multi-faceted surface; and the gripping portion includes jaws that are complementary in shape to the multi-faceted surface such that the engagement of the gripping portion with the groove positively locks the wrench from rotating relative to the cap.

11. In combination, a closure assembly and a container, the closure assembly being configured to seal an opening provided in the container, comprising:

a container body;

a cap including a radially outer lip, a radially inner projection, and a groove located therebetween, and a threaded portion configured for threaded engagement with the container body; and a wrench including a handle and a gripping portion, wherein at least part of the gripping portion is configured to extend into the groove in an assembled position with the gripping portion engaging the outer lip and the inner projection such that rotation of the wrench in opposite directions results in the cap being loosened or tightened relative to the container body.

12. A method for sealing an opening provided in a container with a closure assembly comprising a cap including a radially outer lip, a radially inner projection, and a groove located therebetween, and a threaded portion configured for threaded engagement with a container, the method comprising:

directing a wrench having a handle and a gripping portion into engagement with the cap such that at least part of the gripping portion extends into the groove to engage the outer lip and the inner projection; and rotating the wrench to thereby loosen or tighten the cap relative to the container.

13. The method of claim 12, wherein rotating the wrench further comprises:

rotating in a first direction to loosen the cap relative to the container; and rotating in a second direction to tighten the cap relative to the container.

14. The method of claim 12, wherein:

during the rotating step, a position of the wrench relative to the cap remains substantially constant.

15. The method of claim 12, further comprising:

disengaging the wrench and the cap; and storing the wrench.

16. The method of claim 15, wherein storing the wrench further comprises:

magnetically coupling the wrench to an object.

17. The method of claim 12, further comprising:

lifting and removing the cap from the container using the wrench once the cap is sufficiently loosened relative to the container.

18. The method of claim 17, wherein:

lifting and removing the cap relies at least in part on close engagement between the groove and the gripping portion.

19. The method of claim 12, wherein the wrench includes a flange projecting transversely from the handle, and directing the wrench into engagement with the cap further comprises:

engaging an outer portion of the outer lip with the flange.

20. The method of claim 12, wherein the gripping portion includes a pair of opposing jaws, and directing the wrench into engagement with the cap further comprises:

engaging the inner projection with the jaws.

21. The method of claim 20, wherein a portion of each of the jaws extends generally parallel to one another, and directing the wrench into engagement with the cap further comprises:

engaging generally parallel portions of the inner projection with the jaws.

* * * * *